US009538885B2

(12) United States Patent
Cojocaru et al.

(10) Patent No.: US 9,538,885 B2
(45) Date of Patent: Jan. 10, 2017

(54) DISPOSABLE MOIST TISSUE DISPENSER

(71) Applicants: WipeMeWorld Ltd., Hong Kong (CN); Hung Tak Wai, Hong Kong (CN)

(72) Inventors: Ronen Cojocaru, Hong Kong (CN); John Philip Harding, Hong Kong (CN)

(73) Assignee: WIPEMEWORLD LTD., Hong Kong (CN)

( * ) Notice: Subject to any disclaimer, the term of this patent is extended or adjusted under 35 U.S.C. 154(b) by 0 days.

(21) Appl. No.: 14/251,716

(22) Filed: Apr. 14, 2014

(65) Prior Publication Data

US 2014/0312048 A1 Oct. 23, 2014

Related U.S. Application Data

(60) Provisional application No. 61/813,150, filed on Apr. 17, 2013.

(30) Foreign Application Priority Data

Mar. 25, 2014 (CN) ..... 2014 1 0111539

(51) Int. Cl.

| | |
|---|---|
| ***A47K 10/38*** | (2006.01) |
| ***B65D 83/08*** | (2006.01) |
| ***B65D 85/672*** | (2006.01) |
| *A47K 10/32* | (2006.01) |

(52) U.S. Cl.

CPC ..... *A47K 10/38* (2013.01); *B65D 83/0805* (2013.01); *B65D 85/672* (2013.01); *A47K 2010/3266* (2013.01)

(58) Field of Classification Search

CPC ..... A47K 2010/3266

See application file for complete search history.

(56) References Cited

U.S. PATENT DOCUMENTS

| | | | |
|---|---|---|---|
| 3,368,522 | A | 2/1968 | Cordis et al. |
| 3,775,801 | A | 12/1973 | Walker |
| 3,995,582 | A | 12/1976 | Douglas |

(Continued)

FOREIGN PATENT DOCUMENTS

| | | | |
|---|---|---|---|
| DE | 19752164 | A | 8/1998 |
| DE | 20305566 | U | 9/2003 |

(Continued)

*Primary Examiner* — Gene Crawford
*Assistant Examiner* — Kelvin L Randall, Jr.
(74) *Attorney, Agent, or Firm* — Maier & Maier, PLLC

(57) ABSTRACT

The disclosure describes a disposable moist tissue dispenser applicable to dispensing of moist tissues. The invention includes a center roller, a pair of side panels, a housing, a moist tissue roll, an outlet, and a resealable cover. The side panels are separately attached at opposite ends of the center roller. The housing is disposed about the center roller and is attached to an outer edge along each side panel. The center roller, side panels, and housing form an interior space. The moist tissue roll resides within the interior space and includes a plurality of separable moist tissues. The moist tissue roll is disposed about and rotatable with respect to the center roller. The outlet is disposed along a portion of the housing for dispensing the separable moist tissues from the moist tissue dispenser. The resealable cover is disposed along the housing over the outlet.

11 Claims, 9 Drawing Sheets

(56) References Cited

U.S. PATENT DOCUMENTS 4,239,164 A * 12/1980 Barnsbee ..... G03B 27/588 206/409
4,570,820 A * 2/1986 Murphy ..... B65D 33/24 206/210
5,368,157 A * 11/1994 Gasparrini et al. ..... 206/209
5,439,521 A * 8/1995 Rao ..... A47K 10/3827 118/415
5,660,313 A 8/1997 Newbold
5,897,074 A 4/1999 Marino
6,056,235 A * 5/2000 Brozinsky ..... 242/598.6
6,382,552 B1 5/2002 Williams et al.
6,503,326 B1 * 1/2003 Mikelionis ..... A47K 10/32 118/419
6,536,707 B2 * 3/2003 Adelakun ..... A47K 10/38 242/160.1
6,568,625 B2 5/2003 Bohnsack et al.
6,827,309 B1 12/2004 Stanca et al.
6,994,292 B2 2/2006 Cain et al.
7,294,378 B2 11/2007 Cwiakala et al.
7,311,221 B2 12/2007 Serfaty
7,404,500 B2 * 7/2008 Marteau et al. ..... 221/228
7,775,350 B2 8/2010 Palamountain
8,104,847 B2 * 1/2012 Colon et al. ..... 312/34.8
D661,600 S 6/2012 Bell et al.
8,511,511 B2 * 8/2013 Thoren et al. ..... 221/63
2002/0162848 A1 * 11/2002 Na ..... A47K 10/38 221/63
2003/0218040 A1 11/2003 Faulks et al.
2004/0108409 A1 6/2004 Shahbaz
2004/0206651 A1 10/2004 Miyazawa et al.
2007/0080256 A1 * 4/2007 Collins ..... 242/598.6
2007/0157877 A1 7/2007 Barnes et al.
2008/0164369 A1 * 7/2008 Adelakun ..... A47K 10/16 242/579
2011/0139807 A1 * 6/2011 Ray et al. ..... 221/1
2014/0027464 A1 * 1/2014 Huang ..... A47K 10/38 221/45

FOREIGN PATENT DOCUMENTS

EP 0501905 A 9/1992
EP 1274335 A 4/2001
ES 1058715 U 2/2005
JP 9149863 A 6/1997
JP 2002000500 A 1/2002
JP 2002255260 A 9/2002
JP 2005271980 A 1/2005
JP 2011167335 A 9/2011
KR 100855830 B 10/2002
NL 1016518 C 5/2002
WO 9621388 A 7/1996
WO 9808763 A 3/1998

* cited by examiner

DISPOSABLE MOIST TISSUE DISPENSER

CROSS REFERENCE TO RELATED APPLICATIONS

This application is based upon and claims priority from U.S. Provisional Patent Application No. 61/813,150 filed Apr. 17, 2013 entitled Disposable Dispenser of Moist Toilet Tissue. This application also is based upon and claims priority from Chinese Patent Application No. 201410111539.4 filed Mar. 25, 2014 entitled A Moist Tissue Roll Dispenser. The subject matters of the prior applications are incorporated in their entirety herein by reference thereto.

FEDERALLY SPONSORED RESEARCH AND DEVELOPMENT

None.

BACKGROUND OF THE INVENTION

1. Field of the Invention

The present invention generally relates to a tissue dispenser and more specifically to a disposable moist tissue dispenser which can be used in restaurants, offices, and homes and in particular within bathrooms and washrooms for providing moist tissues.

2. Background

Tissue dispensing devices found in most bathrooms and washrooms include dry tissue rolls. A typical dry tissue roll is attached to a tissue dispenser by sliding the roll onto a spindle within the tissue dispenser. A user dispenses tissues by pulling on a tissue extending from the dry tissue roll which causes the tissue roll to rotate about the spindle thereby unwinding tissues from the dry tissue roll. The cleanliness and comfortability of dry tissues are inferior to moist tissues.

Moist tissues are widely commercialized; however, products are limited in that the moist tissues are packaged in a planar-disposed fashion typically within a box. As such, moist tissues have not been commercialized in a form allowing for attachment to tissue dispensing devices found in most bathrooms and washrooms.

Furthermore, planar-disposed moist tissues are organized in an overlapping fashion. This packaging approach allows a user to pull out a single sheet of moist tissue thereby positioning the next piece within an outlet along the dispenser. A limitation of this packaging approach is that each sheet must be individually pulled from the dispenser. This functionality does not allow a user to quickly, easily, and conveniently dispense multiple sheets via a single, continuous pulling motion. Also, present dispenser designs require a sheet of moist tissue to partially extend from the outlet of the dispenser exposing the sheet to contaminants adjacent to the dispenser and allowing for evaporation of liquid from the exposed sheet, as well as others sheets within the dispenser.

Accordingly, what is required is a disposable moist tissue dispenser capable of quickly, easily, and conveniently dispensing moist tissues via a continuous pulling motion.

SUMMARY OF THE INVENTION

An object of the invention is to provide a disposable moist tissue dispenser capable of quickly, easily, and conveniently dispensing moist tissues via a continuous pulling motion.

In accordance with some embodiments, the invention includes a center roller, a pair of side panels, a housing, a moist tissue roll, an outlet, and a resealable cover. The side panels are separately attached at opposite ends of the center roller. The housing is disposed about the center roller and is attached to an outer edge along each side panel. The center roller, side panels, and housing form an interior space. The moist tissue roll resides within the interior space and includes a plurality of separable moist tissues. The moist tissue roll is disposed about the center roller and rotatable with respect to the center roller. The outlet is disposed along a portion of the housing for dispensing the moist tissues from the moist tissue dispenser. The resealable cover is disposed along the housing over the outlet.

In accordance with other embodiments, the moist tissue roll includes a cylindrical core. The moist tissues are disposed around the cylindrical core. A plurality of perforations is disposed between adjacent moist tissues. The moist tissues are separable via the perforations.

In accordance with other embodiments, the outlet is circular shaped.

In accordance with other embodiments, the outlet grips the moist tissues when pulled through the outlet.

In accordance with other embodiments, the outlet is disposed along a plug attached an opening along the housing.

In accordance with other embodiments, the outlet is cross shaped.

In accordance with other embodiments, the center roller is hollow.

In accordance with other embodiments, the housing is flexible.

In accordance with other embodiments, the moist tissue dispenser further includes a pair of circular holes with one circular hole through each side panel. Each circular hole defines an inner edge along the side panel. The center roller is aligned with the circular holes adjacent to the inner edges.

In accordance with other embodiments, the moist tissue dispenser further includes a projection ring at each outer edge and at each inner edge. The projection ring adjacent to each outer edge is hermetically connected to the housing. The projection ring adjacent to each inner edge is hermetically connected to the center roller.

In accordance with other embodiments, the side panels and the center roller are composed of a plastic material.

In accordance with other embodiments, the housing is composed of an aluminum composite.

In accordance with other embodiments, the side panels are transparent.

In accordance with other embodiments, at least one side panel includes a decorative sticker thereon.

In accordance with other embodiments, the decorative sticker includes an opening that allows a user to view the moist tissue roll within the moist tissue dispenser.

In accordance with other embodiments, the center roller and the side panels are composed of a PVC plastic.

In accordance with other embodiments, the center roller and the side panels are composed of a PETG plastic.

In accordance with other embodiments, the moist tissue dispenser is disposable.

In accordance with other embodiments, the moist tissue dispenser is utilized with dispenser hardware.

Several advantages are noteworthy for the present invention. The invention may be used within bath or toilet facilities within homes, restaurants, or the like. The invention is resealable via a cover with adhesive after each use thereby providing an airtight environment that prevents contamination of the moist tissues and evaporation of liquid from the moist tissues. The invention can be practicably used for multiple purposes and is easily commercialized and promoted.

The above and other objectives, features, and advantages of the embodiments of the invention will become apparent from the following description read in connection with the accompanying drawings, in which like reference numerals designate the same or similar elements.

REFERENCE NUMERALS

1 Moist tissue dispenser
2 Moist tissue roll
3 Center roller
4 Side panel
5 Decorative sticker
6 Housing
7 Cylindrical core
8 Opening
9 Circular hole
10 Projection ring
11 Opening
12 Outlet
13 Resealable cover
14 Outlet
15 Moist tissue
16 Perforation
17 Dispenser hardware
18 Lever
19 Outer edge
20 Interior space
21 Inner edge
22 Plug
23 Opening
24 Panel

BRIEF DESCRIPTION OF THE DRAWINGS

Additional aspects, features, and advantages of the invention will be understood and will become more readily apparent when the invention is considered in the light of the following description made in conjunction with the accompanying drawings.

DETAILED DESCRIPTION OF THE INVENTION

Figure 1:
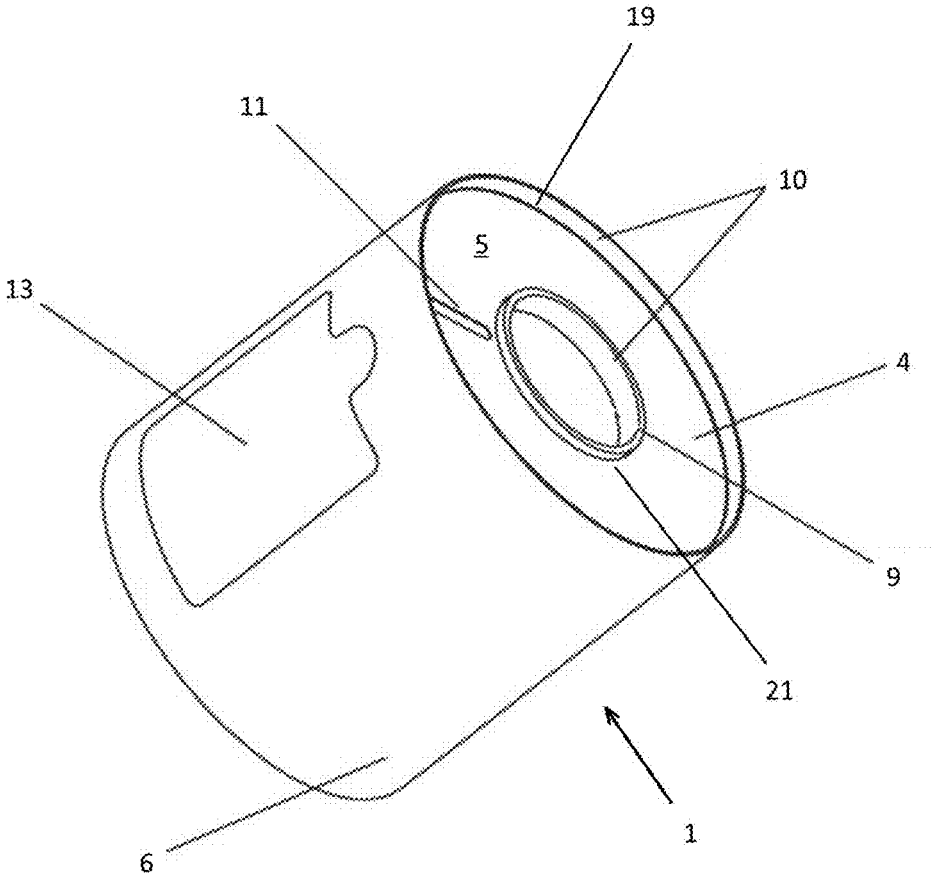
FIG. 1 is a perspective view illustrating a moist tissue dispenser in accordance with an embodiment of the invention.
Figure 2:
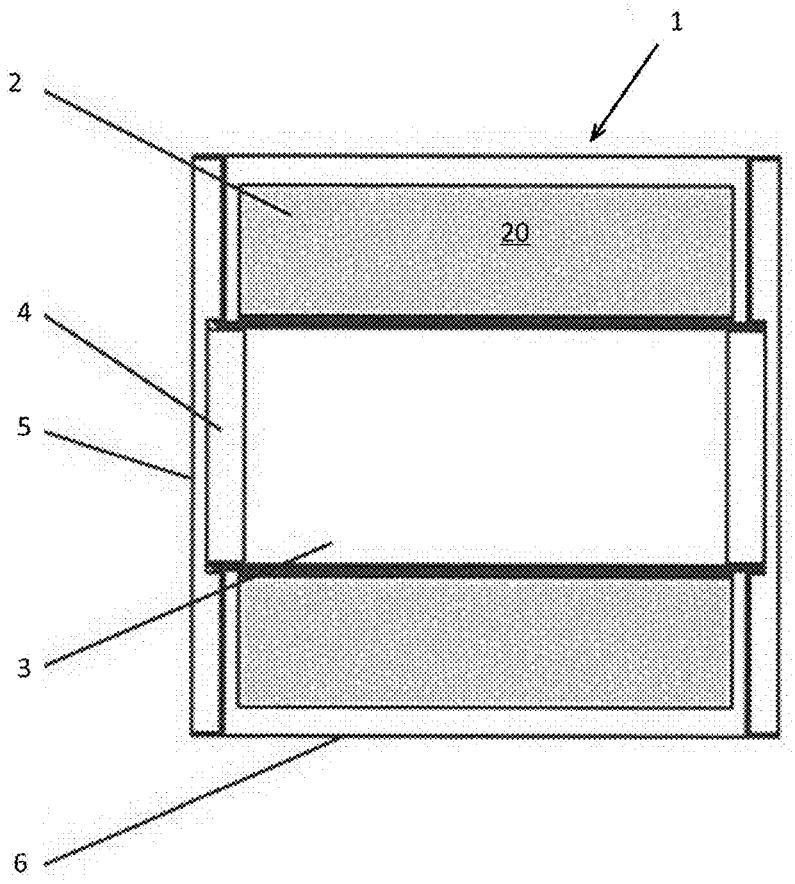
FIG. 2 is a sectional view illustrating a moist tissue dispenser in accordance with an embodiment of the invention.

Reference will now be made in detail to selected embodiments of the invention that are illustrated in the accompanying drawings. Wherever possible, same or similar reference numerals are used in the drawings and the description to refer to the same or like parts. While features are described with specific reference to certain embodiments, it is understood that such features could be combined to form other embodiments. The drawings are in simplified form and are not to precise scale.

Referring now to FIGS. 1-3, 4*a* and 4*b*, the present invention is a moist tissue dispenser 1 that includes a center roller 3, a pair of side panels 4 separately attached at the opposite ends of the center roller 3, and a housing 6 disposed about the center roller 3 and attached to the outer edge 19 of each side panel 4. The center roller 3, side panels 4, and housing 6 cooperate to form an interior space 20 for containing a moist tissue roll 2 and sealing the moist tissue roll 2 from the environment surrounding the moist tissue dispenser 1. The moist tissue roll 2 is disposed about the center roller 3 and is rotatable with respect to the center roller 3. The moist tissue roll 2 includes a cylindrical core 7 and a plurality of moist tissues 15 rolled or coiled about the cylindrical core 7. The moist tissues 15 are disposed in an end-to-end arrangement to form a continuous sheet. A plurality of perforations 16 is disposed between adjacent moist sheets 15. The perforations 16 allow one moist sheet 15 to be separated from another moist sheet 15 via tearing of tissue material adjacent to the perforations 16.

The moist tissue roll 2 is positioned along and disposed about the center roller 3. The outer diameter of the center roller 3 is smaller than the inner diameter of the cylindrical core 7 so as to allow the moist tissue roll 2 to slide over the center roller 3 during assembly and to rotate with respect to the center roller 3 during dispensing. The center roller 3 is made of plastic or semi-plastic material. The ends of the center roller 3 are separately coupled to one side panel 4 via a circular hole 9 along the center of each side panel 4. The inner diameter of each circular hole 9 is sufficiently large so as to slidingly engage the outer diameter of the center roller 3. A projection ring 10 is disposed along the outer edge 19 of each side panel 4 and the inner edge 21 of each circular hole 9. The projection ring 10 at the outer edge 19 of each side panel 4 is hermetically connected to the surface housing 6. The projection ring 10 at the inner edge 21 of each circular hole 9 is hermetically connected to an adjacent end of the center roller 3.

The side panels 4 are typically, but not necessarily, circular shaped. By way of example only, the side panels 4 could be hexagonal shaped. The side panels 4 could also be transparent or opaque. The center roller 3 and the side panels 4 are preferred to be made of one or more plastic materials, preferably PVC or PETG, so that the center roller 3 and side panels 4 are lightweight, rigid, waterproof, and conducive to a hermetic seal. An optional decorative sticker 5 is disposed on the outer surface of one or both side panels 4 to mask the appearance of the side panels 4 or to improve the aesthetics of the moist tissue dispenser 1.

Figure 5:
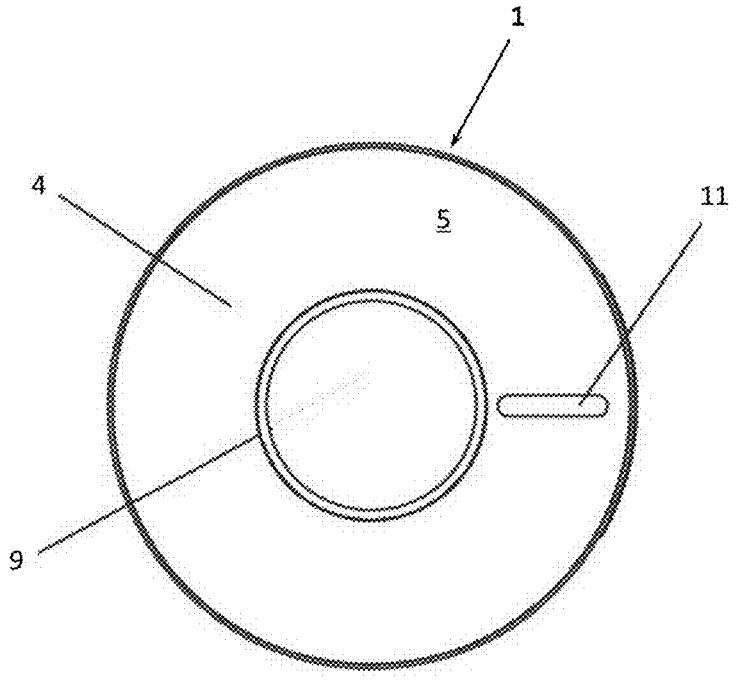
FIG. 5 is a side view illustrating a side panel in accordance with an embodiment of the invention.

Referring now to FIGS. 1 and 5, the decorative sticker 5 could include an optional opening 11 which allows a user to visually inspect the moist tissue roll 2 to determine the amount of moist tissues 15 remaining in the moist tissue dispenser 1. The decorative sticker 5 could be made of an aluminized composite membrane or other suitable material.

Referring again to FIGS. 1-3, and 4*a*, the outer diameter of the moist tissue roll 2 should be smaller than the inner diameter of the housing 6 so that the moist tissue roll 2 is freely rotatable within an airtight environment with respect to the housing 6 as well as the center roller 3. In preferred embodiments, the housing 6 has a cylindrically-shaped cross section with open ends; however, the housing 6 may include other designs including, but not limited to, a barrel shape with a hexagonal cross section. The housing 6 is made of a transparent or non-transparent flexible material, an example of the latter being an aluminum composite. Trademarks, indicia, designs, and/or graphics could be applied to the outer surface of the housing 6 to improve the aesthetics of the moist tissue dispenser 1 or to communicate information, instructions, or advertising.

Figure 3:
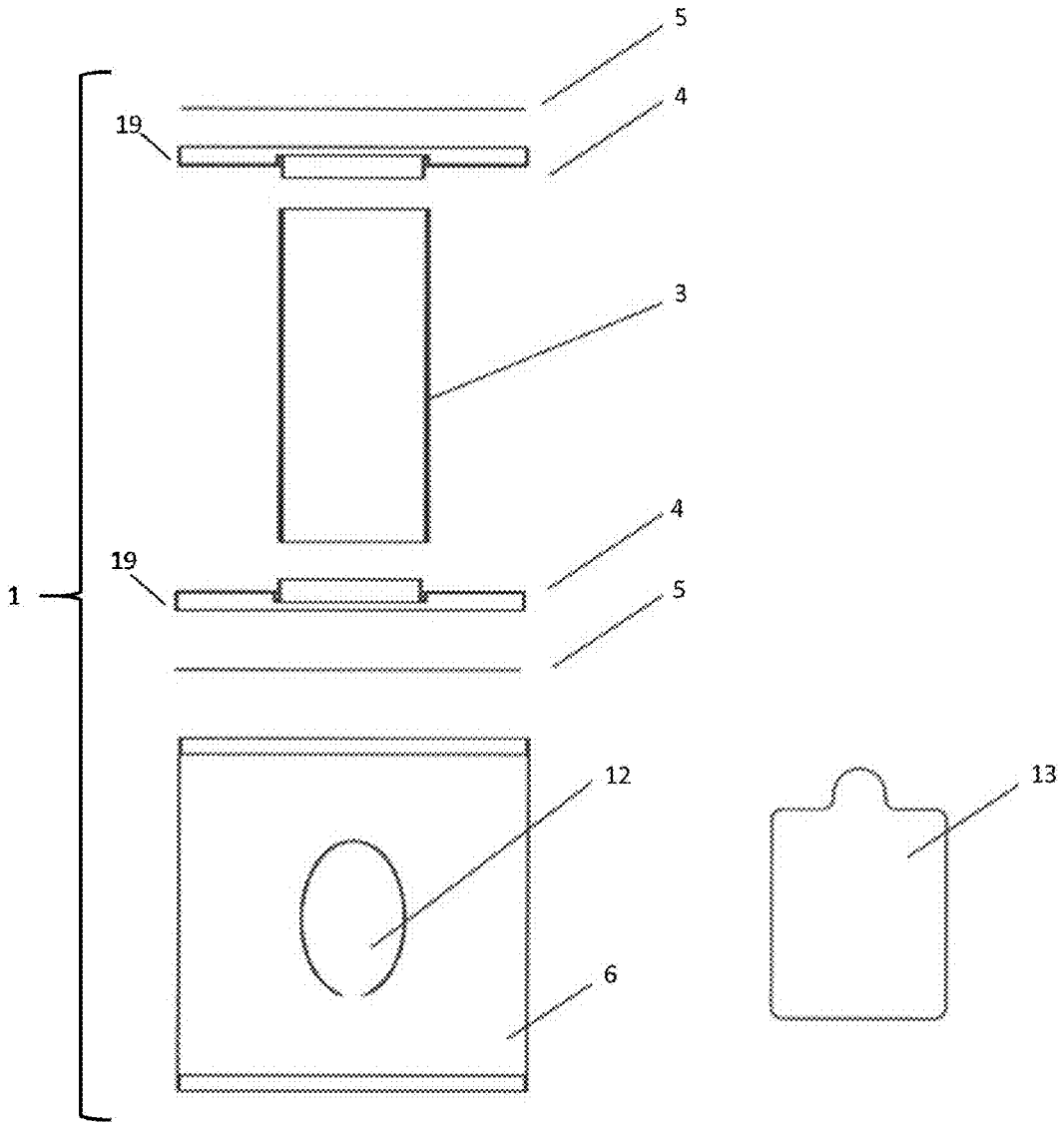
FIG. 3 is an exploded view illustrating a moist tissue dispenser (moist tissue roll not shown) in accordance with an embodiment of the invention.
Figure 4A:
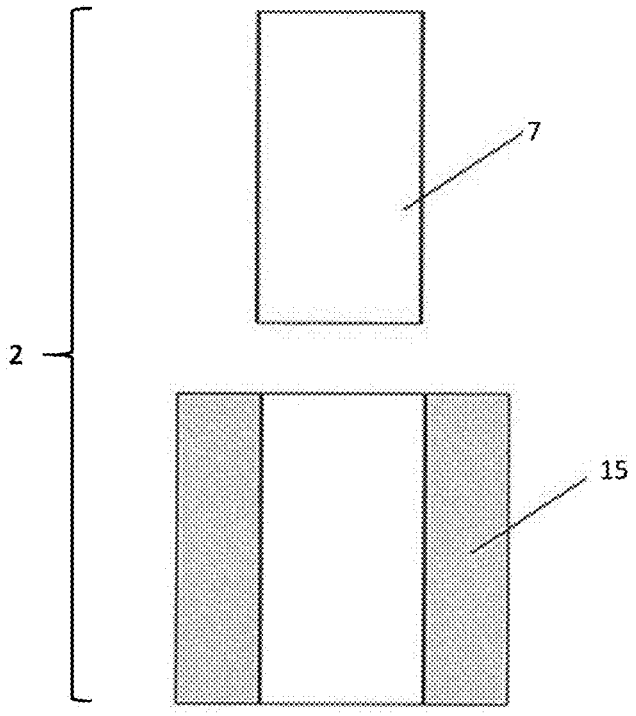
FIG. 4*a* is an exploded view illustrating a moist tissue roll in accordance with an embodiment of the invention.
Figure 4B:
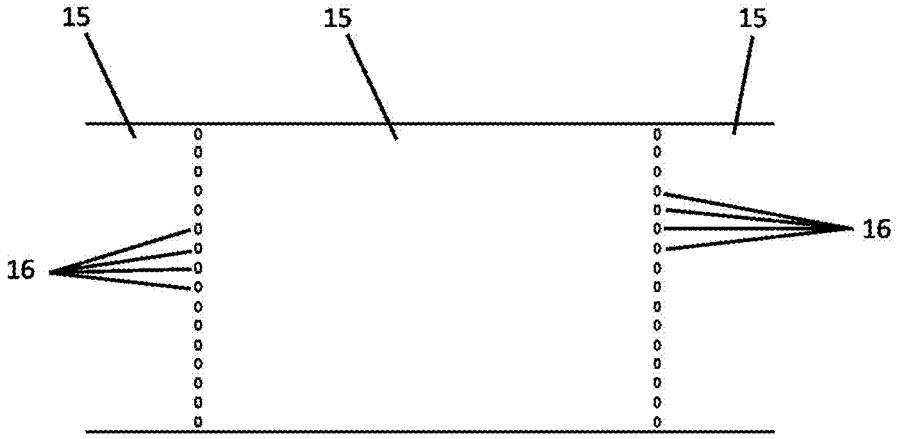
FIG. 4*b* is a plan view illustrating adjacent moist tissues separated by a plurality of perforations which facilitating separation of one moist tissue in accordance with an embodiment of the invention.
Figure 6:
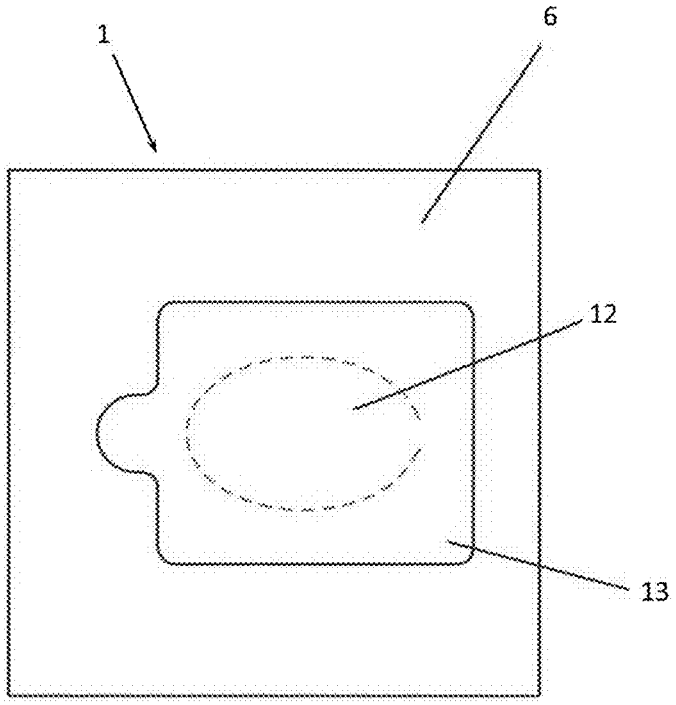
FIG. 6 is a front view illustrating a resealable cover along the exterior of a moist tissue dispenser with an enlarged outlet in accordance with an embodiment of the invention.

Referring now to FIGS. 1, 3, and 6, an outlet 12 is disposed along the housing 6. The outlet 12 allows a user to remove moist tissues 15 from the moist tissue dispenser 1. The outlet 12 could be an opening shaped and/or sized to allow moist tissues 15 to freely traverse the housing 6. The outlet 12 is covered by a resealable e cover 13. The resealable cover 13 is a sealable sticker-like element, as represented in FIG. 6, or a sealable plastic lid or the like. The resealable cover 13 should enable a user to uncover the outlet 12 prior to extraction of a moist tissue 15 from the moist tissue dispenser 1 and further enable a user to cover the outlet 12 after completion of the extraction process. The resealable cover 13 should facilitate multiple openings and closings commensurate with the quantity of moist tissues 15 within and anticipated lifecycle of the moist tissue dispenser 1.

Figure 7:
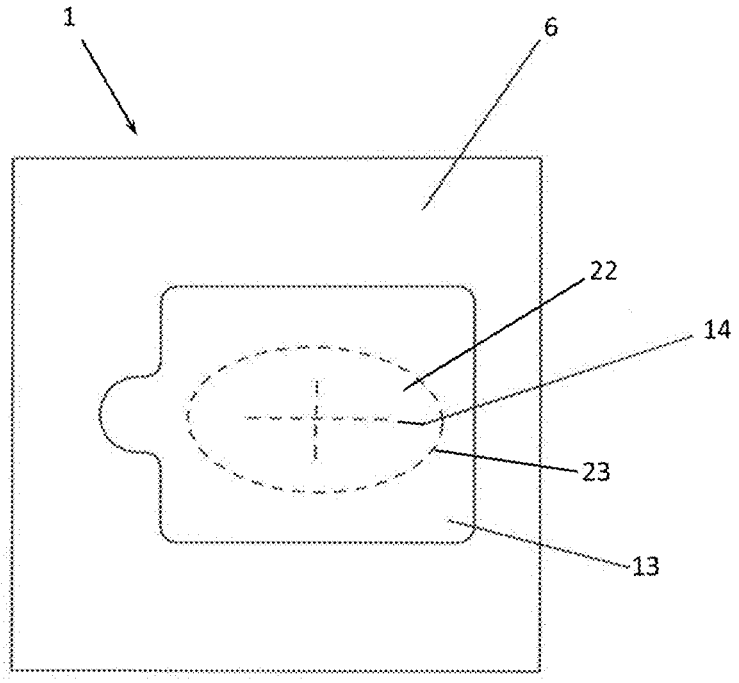
FIG. 7 is a front view illustrating a resealable cover along the exterior of a moist tissue dispenser with a cross-shaped outlet that grips moist tissues as each is extracted from the dispenser in accordance with an embodiment of the invention.

Referring now to FIG. 7, optional embodiments of the moist tissue dispenser 1 could include an outlet 14 which is shaped and/or sized to interact with the moist tissues 15 as the moist tissues 15 traverse the housing 6. The outlet 14 could include a pair of slits, slots, or linear-shaped openings which intersect in a crosswise arrangement as represented in FIG. 7; however, other shapes and designs are possible. When a moist tissue 15 is extracted from the moist tissue dispenser 1 via the outlet 14, the outlet 14 interacts with the moist tissue 15 thereby applying a frictional or drag force which is less than the extraction force applied to the outermost moist tissue 15 by a user. The resultant forces ensure complete extraction of the outermost moist tissue 15 grasped by the user and placement of a portion of the next moist tissue 15 into contact with the outlet 14 so that the perforations 16 between the adjacent moist tissues 15 now reside outside the moist tissue dispenser 1. Depending on the extraction force, the frictional or drag force could resist extraction of the moist tissue 15 disposed within the outlet 14 so that the resultant forces and stresses within the partially extracted moist tissue 15 cause the moist tissue 15 to tear adjacent to the perforations 16. The result is separation of the outermost moist tissue 15 from the moist tissue 15 within the outlet 14, thereby controlling and limiting the quantity of moist tissues 15 dispensed from the moist tissue dispenser 1. The outlet 14 could reside along the housing 6 and be covered by the resealable cover 13. In some embodiments, the outlet 14 could reside along a plug 22, composed of a plastic material, secured to an opening 23 along the housing 6, as represented in FIG. 7. The plug 22 could be covered by the resealable cover 13.

Referring again to FIGS. 1-7, the moist tissue dispenser 1 is assembled from various required and optional elements. A first side panel 4 is coupled to one end of the center roller 3, preferably hermetically. A moist tissue roll 2 is then assembled onto the center roller 3 by sliding the moist tissue roll 2 onto the center roller 3 via the end without a side panel 4 and toward the end attached to the side panel 4. A second side panel 4 is then coupled to the center roller 3, preferably hermetically. A housing 6 with an outlet 12 or 14 or an opening 23 is then connected to the side panels 4, preferably hermetically sealed thereto. A plug 22 with outlet 14 is attached to the opening 23 along housing 6 when the housing 6 includes an opening 23. An optional decorative sticker 5 is attached to one or both side panels 4. A resealable cover 13 is coupled to the housing 6 over the outlet 12 or 14 or the plug 22 with outlet 14. The moist tissue dispenser 1 is usable until all moist tissues 15 are dispensed after which the moist tissue dispenser 1 may be disposed.

Figure 8:
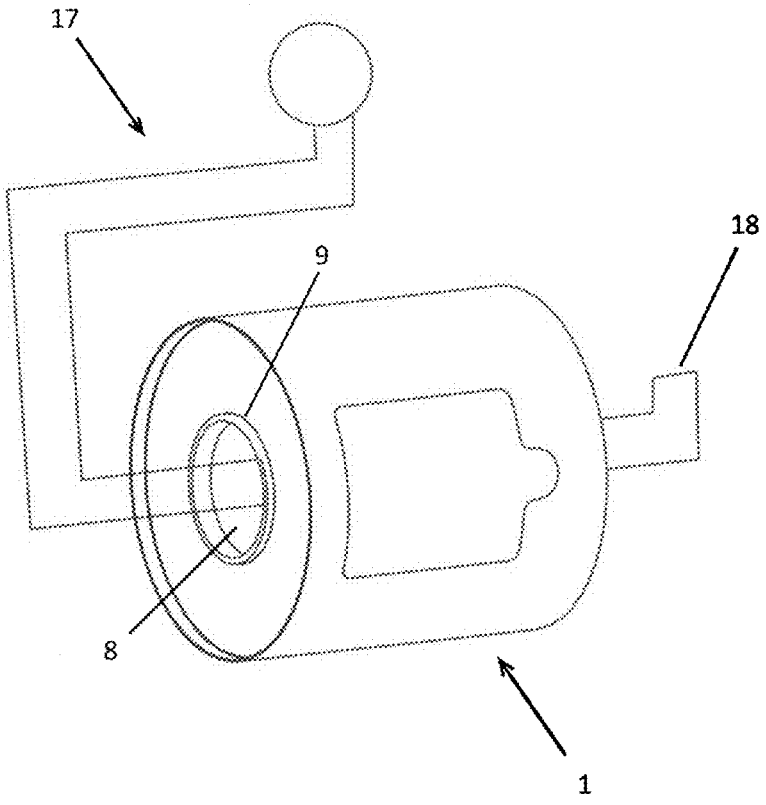
FIG. 8 is a schematic view illustrating a moist tissue dispenser utilized with an exemplary dispenser device in accordance with a first embodiment of the invention.

In some exemplary embodiments, the center roller 3 is a cylindrically-shaped element with an opening 8 along its length, as shown in FIG. 8. The ends of the center roller 3 are separately coupled to a side panel 4 via a circular hole 9 disposed along the side panel 4 as described herein. This arrangement aligns the opening 8 along the center roller 3 with the circular holes 9. In this configuration, the moist tissue dispenser 1 could be coupled to items found in many residential, commercial, and industrial applications. By way of an example, the moist tissue dispenser 1 could contact a dispenser hardware 17 including a substantially horizontal lever 18, as represented in FIG. 8. The moist tissue dispenser 1 is connected to the dispenser hardware 17 by inserting the lever 18 into and through the openings 8, 9 so that the level 18 completely traverses the moist tissue dispenser 1. The lever 18 could include a flange or other mechanical feature known within the art that prevents the moist tissue dispenser 1 from separating from the dispenser hardware 17 during use.

Figure 9:
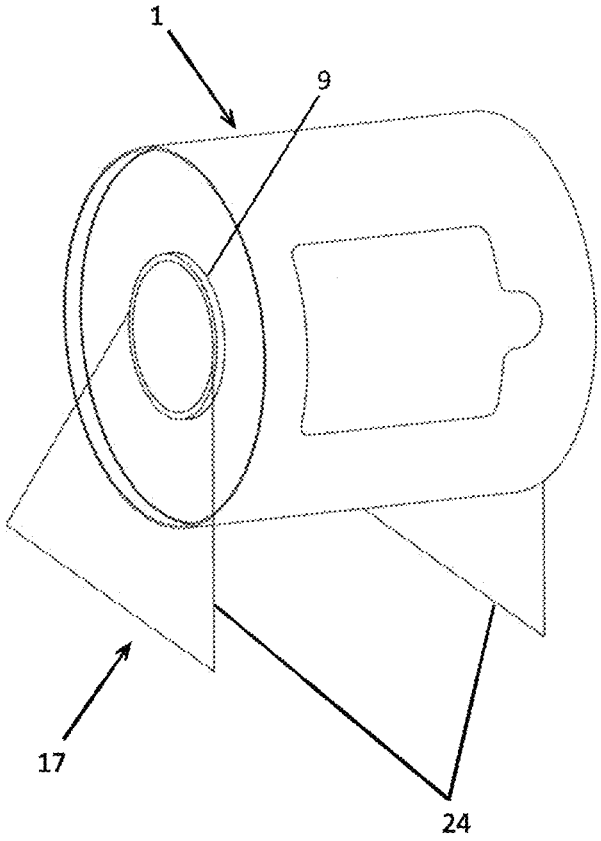
FIG. 9 is a schematic view illustrating a moist tissue dispenser utilized with an exemplary dispenser device in accordance with a second embodiment of the invention.

In other exemplary embodiments, the center roller 3 is a cylindrically-shaped solid structure. The ends of the center roller 3 are attached to the side panels 4 as otherwise described herein. The center roller 3, side panels 4, and housing 6 shield the moist tissue roll 2 from the surrounding environment and allow the moist tissue roll 2 to be freely rotatable therein. In this configuration, the moist tissue dispenser 1 could be coupled to items found in many residential, commercial, and industrial applications. By way of an example, a pair of panels 24 is suitably shaped to form a dispenser hardware 17 in the form of a stand, as represented in FIG. 9. Each panel 24 could include one or more features which engage the center roller 3 and/or the side panel 4, thereby fixing the moist tissue dispenser 1 to the dispenser hardware 17.

Referring again to FIGS. 1, 2, 8, and 9, a user extracts one or more moist tissues 15 from the moist tissue dispenser 1 by opening the resealable cover 13, pulling one or more moist tissues 15 from the moist tissue dispenser 1, and separating the moist tissue(s) 15 outside the moist tissue dispenser 1 from the moist tissue(s) 15 remaining within the moist tissue dispenser 1. The moist tissue roll 2 rotates with respect to the moist tissue dispenser 1 and the dispenser hardware 17 during extraction of the moist tissues 15. The resealable cover 13 is closed after use.

The description above indicates that a great degree of flexibility is offered in terms of the present invention. Although various embodiments have been described in considerable detail with reference to certain preferred versions thereof, other versions are possible. Therefore, the spirit and scope of the appended claims should not be limited to the description of the preferred versions contained herein. Any amendment, replacement and improvement made according to the principle and essence of the present invention should be within scope of protection.

What is claimed is:

1. A disposable moist tissue dispenser comprising:

(a) a center roller;

(b) a pair of side panels separately attached at opposite ends of said center roller;

(c) a flexible housing composed of an aluminum composite disposed about said center roller, said housing attached to an outer edge along each said side panel, an interior space formed by said center roller, said side panels, and said housing;

(d) a moist tissue roll residing within said interior space, said moist tissue roll includes a plurality of separable moist tissues, said moist tissue roll disposed about said center roller and rotatable with respect to said center roller;

(e) an outlet disposed along a portion of said housing for dispensing said moist tissues from said moist tissue dispenser, said outlet shaped or sized so as to allow said moist tissues to freely traverse said housing when pulled through said housing;

(f) a resealable cover disposed along said housing over said outlet, the resealable element being a sealable like; sticker;

(g) a pair of circular holes, one said circular hole through each said side panel, each said circular hole defines an inner edge along said side panel, said center roller aligned with said circular holes adjacent to said inner edges; and (h) a projection ring at each said outer edge and at each said inner edge, said projection ring adjacent to each said outer edge hermetically connected to said housing, said projection ring adjacent to each said inner edge hermetically connected to said center roller;

wherein at least one said side panel includes a decorative sticker thereon said decorative sticker includes an opening that allows a user to view said moist tissue roll within said moist tissue dispenser.

2. The disposable moist tissue dispenser of claim 1, wherein said moist tissue roll includes a cylindrical core, said moist tissues disposed around said cylindrical core, a plurality of perforations disposed between adjacent said moist tissues, said moist tissues separable via said perforations.

3. The disposable moist tissue dispenser of claim 1, wherein said outlet is circular shaped.

4. The disposable moist tissue dispenser of claim 1, wherein said outlet is disposed along a plug attached to an opening along said housing.

5. The disposable moist tissue dispenser of claim 1, wherein said center roller is hollow.

6. The disposable moist tissue dispenser of claim 1, wherein said side panels and said center roller are composed of a plastic material.

7. The disposable moist tissue dispenser of claim 1, wherein said side panels are transparent.

8. The disposable moist tissue dispenser of claim 7, wherein said center roller and said side panels are composed of a PVC plastic.

9. The disposable moist tissue dispenser of claim 7, wherein said center roller and said side panels are composed of a PETG plastic.

10. The disposable moist tissue dispenser of claim 1, wherein said moist tissue dispenser is disposable.

11. The disposable moist tissue dispenser of claim 1, wherein said moist tissue dispenser is utilized with a dispenser hardware.

* * * * *